US008757574B2

(12) United States Patent
Bauck et al.

(10) Patent No.: US 8,757,574 B2
(45) Date of Patent: Jun. 24, 2014

(54) HOSE REEL MOUNTING TUBE CONSTRAINT

(75) Inventors: Mark L. Bauck, Coon Rapids, MN (US); Zaixing You, Phoenix (CN); Lihui Gao, PingJiang District (CN); Xueshui Wu, Phoenix (CN); Jin Tian, Can Lang Borough (CN)

(73) Assignee: Graco Minnesota Inc., Minneapolis, MN (US)

( * ) Notice: Subject to any disclaimer, the term of this patent is extended or adjusted under 35 U.S.C. 154(b) by 70 days.

(21) Appl. No.: 13/394,928

(22) PCT Filed: Oct. 27, 2010

(86) PCT No.: PCT/US2010/054326

§ 371 (c)(1),
(2), (4) Date: Mar. 8, 2012

(87) PCT Pub. No.: WO2011/059709

PCT Pub. Date: May 19, 2011

(65) Prior Publication Data

US 2012/0168551 A1 Jul. 5, 2012

Related U.S. Application Data

(60) Provisional application No. 61/256,210, filed on Oct. 29, 2009.

(51) Int. Cl.
*B65H 75/44* (2006.01)

(52) U.S. Cl.
CPC ..... *B65H 75/4431* (2013.01); *B65H 75/4463* (2013.01); *B65H 75/4471* (2013.01); *B65H 75/4457* (2013.01)
USPC ..... 248/330.1; 248/92; 137/355.16; 137/355.26

(58) Field of Classification Search
USPC ..... 248/75, 82, 84, 86, 88, 90, 89, 536; 137/355.16, 355.23, 355.26; 242/118.3, 118.6, 476.1, 530.3, 532.6
See application file for complete search history.

(56) References Cited

U.S. PATENT DOCUMENTS

| | | | | |
|---|---|---|---|---|
| 1,449,730 | A | | 3/1923 | Casper et al. |
| 2,805,100 | A | * | 9/1957 | Shaver ..... 137/355.26 |
| 4,445,495 | A | * | 5/1984 | Frost ..... 126/24 |
| 4,700,737 | A | * | 10/1987 | Nelson ..... 137/355.27 |
| 4,997,116 | A | * | 3/1991 | Grim ..... 224/493 |
| 5,205,521 | A | * | 4/1993 | Smith ..... 248/87 |
| 5,209,420 | A | | 5/1993 | Simmons et al. |
| 6,170,775 | B1 | | 1/2001 | Kovacik et al. |
| 6,439,360 | B1 | | 8/2002 | Miller |

(Continued)

*Primary Examiner* — Tan Le
(74) *Attorney, Agent, or Firm* — Douglas B. Farrow

(57) ABSTRACT

A hose reel (10) is supported by a mounting bracket (12) which can be attached on a vertical or horizontal surface and allow for 180 degrees of motion to allow the hose reel (10) to automatically swivel in the direction the hose (14) is being pulled. The bracket mechanism (16) consists of integral mounting bosses (18) on the hose reel enclosures (20), a mounting bracket (12), a tube (22) and a constraint device (24) on the tube (22). The mounting bosses (18) on the hose reel enclosures (20) are designed to orient and constrain the mounting tube (22) to allow for the tube to be installed from either end of the hose reel. The constraining device (24) on the tube (22) locks into an integral opening (26) in the mounting bosses (18) to prevent tube (22) displacement in either direction.

1 Claim, 2 Drawing Sheets

(56) References Cited

U.S. PATENT DOCUMENTS 6,464,189 B1 * 10/2002 Yu ..... 248/323
D637,067 S * 5/2011 Bauck et al. ..... D8/358
8,292,245 B2 * 10/2012 Schindler et al. ..... 248/80
2002/0195143 A1 12/2002 Paplow et al.
2004/0163710 A1 * 8/2004 Kovacik et al. ..... 137/355.23
2012/0168551 A1 * 7/2012 Bauck et al. ..... 242/398

* cited by examiner

HOSE REEL MOUNTING TUBE CONSTRAINT

TECHNICAL FIELD

This application claims the benefit of U.S. application Ser. No. 61/256,210, filed Oct. 29, 2009, the contents of which are hereby incorporated by reference.

BACKGROUND ART

Prior art hose reel mount designs allow for the mounting tube to be installed from the top end only in vertical installations and either direction in horizontal installations. The disadvantage of such prior art designs is that on horizontal mounting applications the tube is only constrained in one direction.

DISCLOSURE OF THE INVENTION

A hose reel supported by a mounting bracket which can be attached on a vertical or horizontal surface and allow for 180 degrees of motion to allow the hose reel to automatically swivel in the direction the hose is being pulled. The bracket mechanism consists of integral mounting bosses on the hose reel enclosures, a mounting bracket, a tube and a constraint device on the tube. The mounting bosses on the hose reel enclosures are designed to orient and constrain the mounting tube to allow for the tube to be installed from either end of the hose reel. The constraining device on the tube locks into an integral opening in the mounting bosses to prevent tube displacement in either direction.

The advantage of this design is that the tube can be installed from either direction, and once installed is constrained in both directions. This installation is safer for the horizontal installation configuration.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
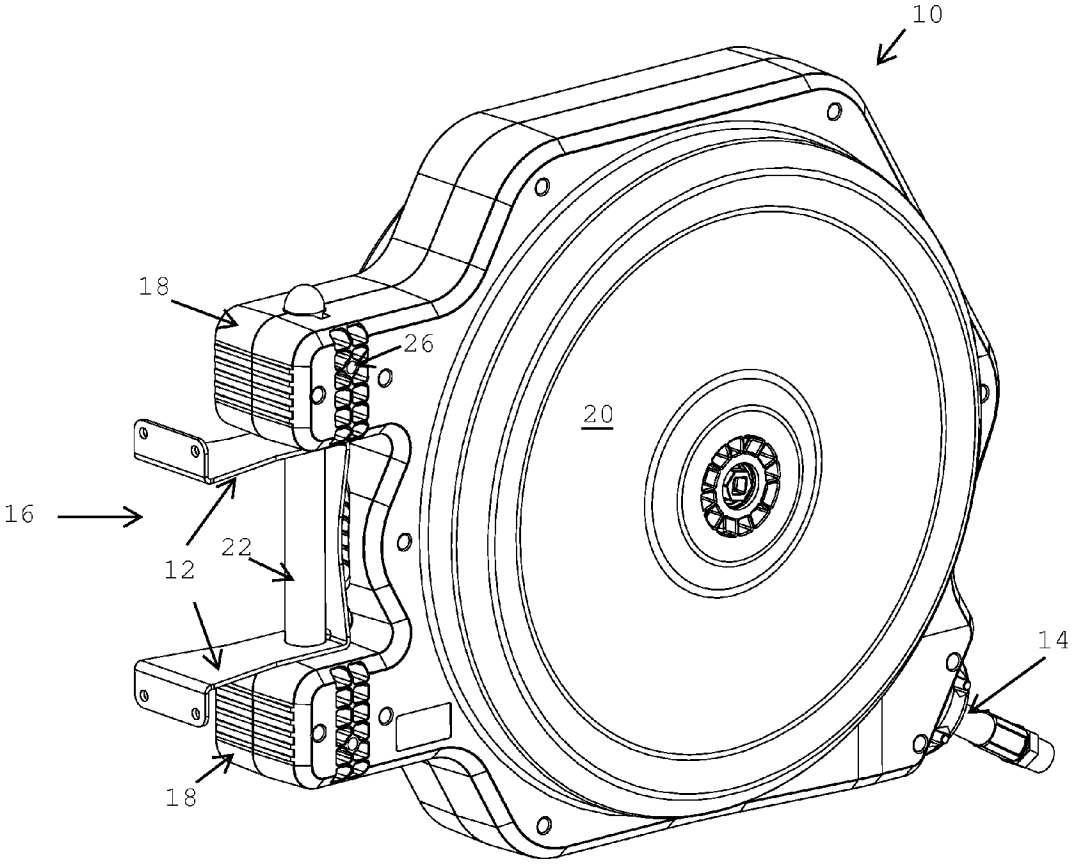
FIG. 1 shows a hose reel utilizing the mounting tube constraint of the instant invention.
Figure 2:
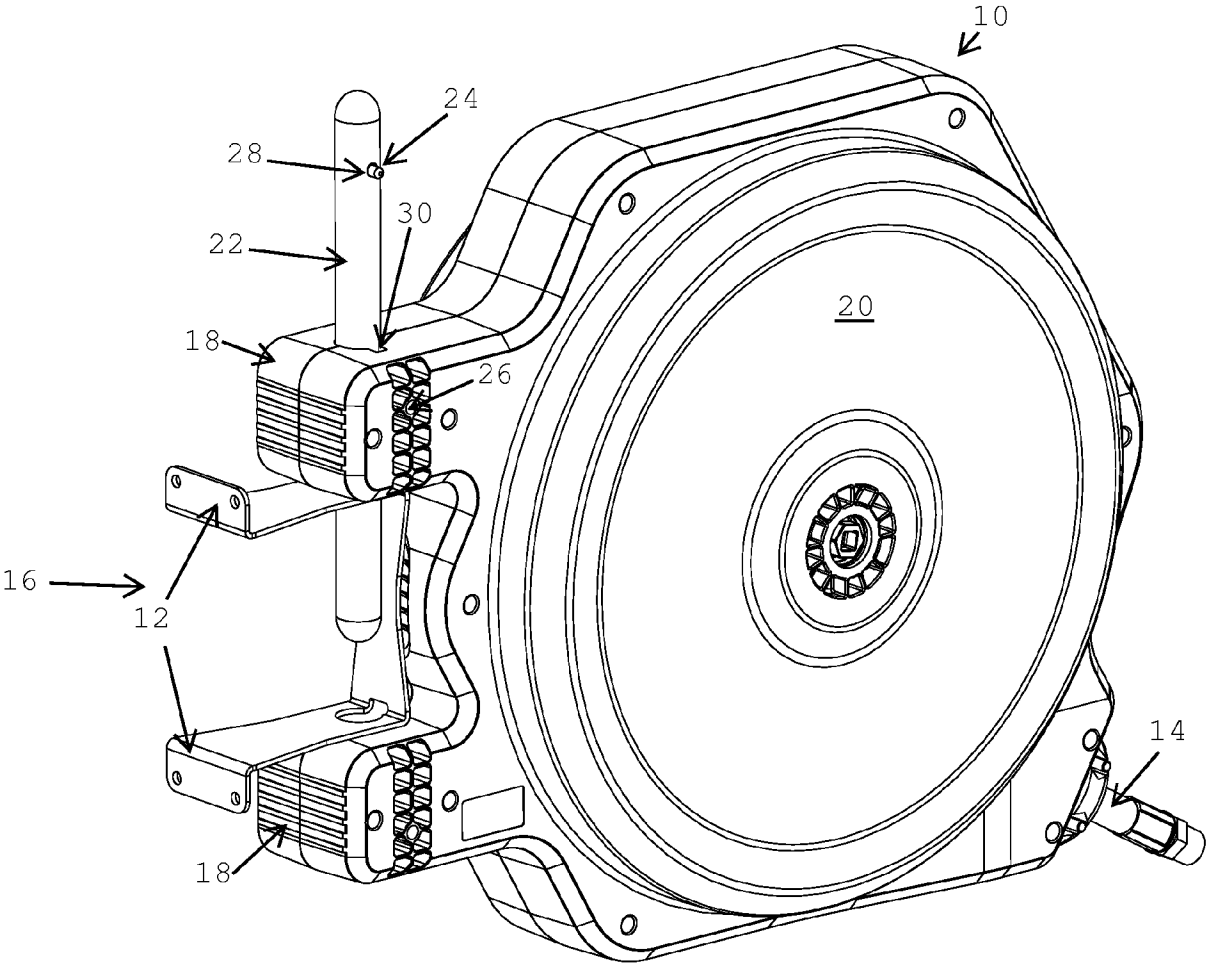
FIG. 2 shows a hose reel utilizing the mounting tube constraint of the instant invention in a partially exploded position.

A hose reel 10 is supported by a mounting bracket 12 which can be attached on a vertical or horizontal surface and allow for 180 degrees of motion to allow the hose reel 10 to automatically swivel in the direction the hose 14 is being pulled. The bracket mechanism 16 consists of integral mounting bosses 18 on the hose reel enclosures 20, a mounting bracket 12, a tube 22 and a constraint device 24 on the tube 22. The mounting bosses 18 on the hose reel enclosures 20 are designed to orient and constrain the mounting tube 22 to allow for the tube to be installed from either end of the hose reel. The constraining device 24 on the tube 22 locks into an integral opening 26 in the mounting bosses 18 to prevent tube 22 displacement in either direction.

In the preferred embodiment, constraint device 24 is comprised of a button clip such as those commonly available (also known as quick-release button connectors, snap buttons or tubing buttons) which include a spring loaded rounded button that extends through a hole in the surface of tube 22. The button 28 may be depressed to be flush with the surface of tube 22 during installation until it is positioned to extend into integral opening 26. A slot 30 may be incorporated into mounting bosses 18 which has a depth less than button 28 extends but which serves to align and guide button 28 into integral opening 26.

It is contemplated that various changes and modifications may be made to the hose reel without departing from the spirit and scope of the invention as defined by the following claims.

The invention claimed is:

1. A hose reel mounting assembly for a hose reel having at least one mounting boss, said mounting assembly comprising:

a mounting bracket;

a mounting tube removably insertable in at least one said mounting boss;

a constraint device extending from said mounting tube and comprising a spring loaded button clip; and an opening in at least one said mounting boss for receiving said constraint device to lock said mounting tube relative to said hose reel and wherein at least one said mounting boss comprises an axial bore for receiving said mounting tube, said bore comprising an axial slot therein to guide said button clip into said opening and compress said button clip and whereby said removable mounting tube is constrained in the axial direction by said button clip.

* * * * *